US005228592A

United States Patent [19]

Pellerano

[11] Patent Number: 5,228,592

[45] Date of Patent: Jul. 20, 1993

[54] SPOUT FOR BOTTLES AND SIMILAR CONTAINERS WITH A PIERCING ELEMENT FOR PIERCING A LID ON RECEPTACLE NECKS

[75] Inventor: Pierre Pellerano, Paris, France

[73] Assignee: Rical S.A., Longvic, France

[21] Appl. No.: 778,984

[22] PCT Filed: May 17, 1990

[86] PCT No.: PCT/FR90/00347

§ 371 Date: Nov. 12, 1991

§ 102(e) Date: Nov. 12, 1991

[87] PCT Pub. No.: WO90/14288

PCT Pub. Date: Nov. 29, 1990

[30] Foreign Application Priority Data

May 17, 1989 [FR] France ..... 89 06434

[51] Int. Cl.[5] ..... B67D 5/00

[52] U.S. Cl. ..... 222/83; 222/91

[58] Field of Search ..... 222/81, 83, 83.5, 85, 222/86, 89, 91

[56] References Cited

U.S. PATENT DOCUMENTS

| | | | |
|---|---|---|---|
| 2,698,113 | 12/1954 | Linton | 222/83 |
| 3,187,918 | 6/1965 | Moore | 222/83 X |
| 3,406,872 | 10/1968 | Fiquet et al. | 222/83 |
| 4,234,103 | 11/1980 | Stroble, Jr. et al. | 222/83.5 |
| 4,706,827 | 11/1987 | Cabernoch et al. | 222/83 X |
| 4,722,449 | 2/1988 | Dubach | 222/83 X |
| 4,795,043 | 1/1989 | Odet et al. | 222/83 X |
| 4,869,399 | 9/1989 | Dubach | 222/83 |
| 4,884,705 | 12/1989 | Debetencourt | 222/83 X |
| 5,094,361 | 3/1992 | Dubach | 222/81 |

FOREIGN PATENT DOCUMENTS

| | | | |
|---|---|---|---|
| 0214095 | 3/1987 | European Pat. Off. . | |
| 0304972 | 3/1989 | European Pat. Off. | 222/83 |
| 0316269 | 5/1989 | European Pat. Off. . | |
| 8002546 | 11/1980 | Int'l Pat. Institute | 222/83 |
| 0004655 | 1/1990 | Japan | 222/83 |
| 1152931 | 5/1969 | United Kingdom . | |

*Primary Examiner*—Andres Kashnikow
*Assistant Examiner*—Kenneth Bomberg
*Attorney, Agent, or Firm*—Beveridge, DeGrandi, Weilacher & Young

[57] ABSTRACT

A spout and sealing cap assembly for a container which contains a product such as a liquid or pasty product. The container includes a nick closed off by a lid that must be pierced for dispensing the product. The assembly includes a spout with a body that is fixed to the neck. The spout also includes a hollow piercing and dispensing element provided with sharp edges designed to pierce the lid. The element is suspended inside the body by a deformable annular bulged membrane which enables the piercing element to assume an upper position and a lower position wherein the sharp edges extend below the ruptured lid. The spout body is covered by a sealing cap which assumes either an open or a closed position. The cap includes a sealing member extending of a top section of the cap. When the cap is closed, the sealing member is designed for insertion in sealing fashion within the hollow element or in a fitting and sealing relationship about the hollow element both when the element is in the upper and the lower position.

13 Claims, 5 Drawing Sheets

SPOUT FOR BOTTLES AND SIMILAR CONTAINERS WITH A PIERCING ELEMENT FOR PIERCING A LID ON RECEPTACLE NECKS

The present invention relates to a spout for bottles and similar containers that contain liquid or pasty products and have a neck which until the first use is closed off by a lid that can be pierced.

Spouts of this type are already known which comprise a body with means for fixing it unto the neck of the container and a hollow element to pierce the lid and to act as a spout for the distribution of the product contained in the container. On those known spouts the piercing element is generally formed by a screw element which is separate from the body and is rotated in order to pierce the lid.

This two-part construction complicates the manufacture and the putting on of the spout and increases the costs.

It also possible to make the piercing element and the body as one single part in the form of a rigid unit, in which case the piercing of the lid takes place by screwing the unit down onto the neck of the container. Such a spout can obviously only be used on threaded necks and not on necks on which the spout is put on by clicking it on. Furthermore, if the spout is not screwed down completely after piercing the lid, leads may occur between the spout and the neck. Moreover, an unintentional screwing down of the spout , e.g. during the handle of the containers, could cause an untimely piercing of the lid.

The present invention seeks to provide a spout with a piercing element for bottles and similar containers the neck of which is closed off by a lid, which spout can be made both as a screw down spout or a click-on spout, is easy to make and functions reliably without the risk of an untimely piercing and leaks. Another object of the invention is a simple and reliable unit comprising such a spout and a sealing cap in particular a sealing cap with together with the spout forms one single part and is connected to the latter by a hinge.

Thus, the spout according to the invention for bottles and similar containers that contain liquid or pasty products and have a neck which until the first use is closed of by a lid that can be pierced, comprises a body provided with means for fixing it onto the neck of the container, and a hollow piercing element to pierce the lid and to act as a spout for dispensing the product container in the container. According to the invention the piercing element arranged inside the body is made as an integral part of the body from a rigid plastic material and is connected to the body by a deformable angular membrane which until the first use is bulged upwards and which, if downward pressure is exerted on the piercing element with a view to piercing the lid, is deformed downwards to assume and then retain a downwardly bulge shape.

Because of the provision and special configuration of the membrane and the fact that the spout unit is made from a rigid plastic material, when the spout is fixed onto the neck of the container the piercing element is held in an inactive position above the lid of the neck, but by a simple downwardly pressure exerted on the piercing element this can be moved downwards to pierce the lid and then remains in the down position when the pressure on the piercing element is relaxed. This membrane accordingly ensures two stable positions for the piercing element, i.e. an inactive position above the lid and an active position for piercing the lid and for dispensing the product container in the containers.

The piercing element may advantageously be arranged concentrically to the body, which ensures that it retains this concentric position in the inactive position and in the active position.

within the scope of the invention the annular membrane may have either an inaccurate profile with double inflection, or a broken line profile with double inflection.

In the latter case it may be advantageous to provide the membrane with a circular weakened zone at each inflection.

If within the scope of the invention the spout is completed by a sealing cap which can be fastened onto the body by screwing or preferably by clicking on, it is advantageous if this cap has an inside sealing skirt with a sufficient length to be able to cooperate with the hollow piercing element even when the latter is in the down-position, i.e. in the active position, after piercing the lid.

In the following several illustrative and non-limitative embodiments of a spout according to the invention will be described in greater detail with reference to the attached diagrammatic drawings, wherein.

Figure 1:
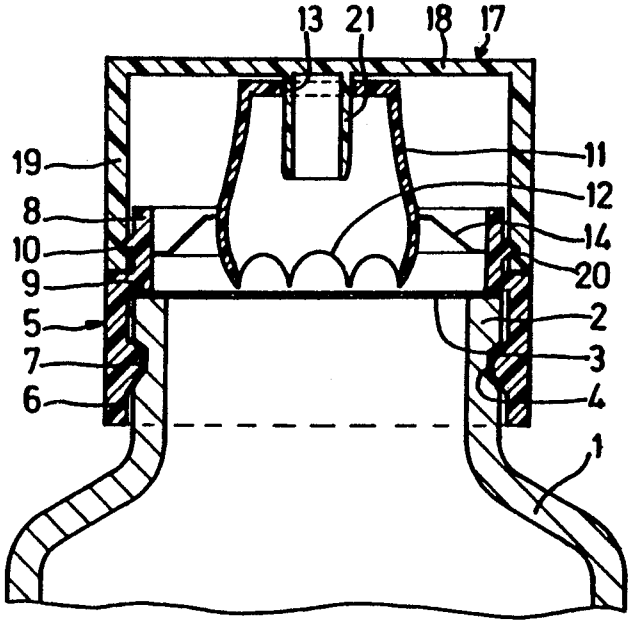
FIG. 1 is an axial cross-section of a spout according to the invention, before piercing the lid of the neck of the bottle.

According to FIG. 1, a bottle 1 for liquid or pasty products has a neck 2 closed off by a lid 3 and provided with an outside groove 4. The material of the cover 3 (sheet of metal, metal/plastic complex, etc. . . ) and the manner in which it is fixed on the neck 2 (thermo-sealing, sealing by HF induction, etc.) do not enter within the scope of the present invention, and all known embodiments can be envisaged.

A spout generally designated by the reference numeral 5 is fixed onto the neck 2 by clicking it on. The spout 5 has a body of a generally cylindrical shape, the bottom part 6 of which, destined to fit onto the neck 2 of the bottle, has an inside rib 7 which co-operates with the groove 4 of the neck 2 by clicking into it, and the upper part 8 of which is connected to the bottom part 6 by an inside shoulder 9 which rests on the outer edge of the lid 3. The upper part 8 of the body is provided with an outside rib 10 for clicking on a sealing cap described further on.

A piercing element 11 in the form of a round hollow body provided at its bottom and with teeth 12 and at its top end with a distribution opening 13, is connected to the inner surface of the upper part 8 of the body by a membrane 14.

Figure 2:
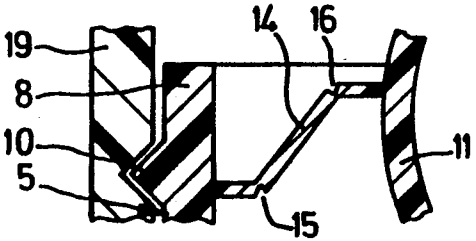
FIG. 2 is a cross-section on a larger scale of the membrane connecting the piercing element to the body of the spout.

The body 5, the piercing element 11 and the membrane 14 are made, as shown in particular on FIG. 2, as one single part from a rigid plastic material such as polypropylene. The membrane 14 has an upwardly bulged shape, i.e. following a broken line profile with a double inflection. According to FIG. 2 the membrane 14 has two circular weakened zones 15, 16 at the points of inflection of its profile.

A sealing cap 17 is fitted onto the upper part 8 of the body 5, which cap 17 has a top 18 from which extend to the one side an outer skirt 19 provided with an annular groove 20 which co-operates by clicking with the rib 10 of the upper part 8 of the body when the cap 17 is put onto the body, and an inside skirt 21 destined to co-operate with the top opening 13 of the piercing element 11.

Figure 3:
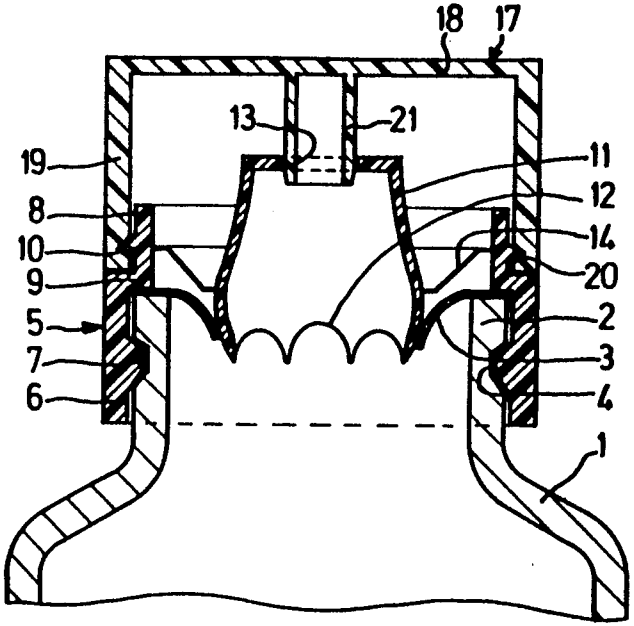
FIG. 3 is a cross-section identical to that of FIG. 1, showing the piercing element in the active position after piercing the lid.
Figure 4:
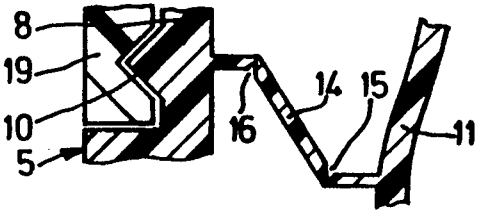
FIG. 4 is a cross-section identical to that of FIG. 2 of the membrane in the position according to FIG. 3.

FIGS. 3 and 4 show the spout after the lid 3 has been pierced by exerting downward pressure on the piercing element 11, after lifting off the cap 17. Under the effect of this pressure exerted on the piercing element 11 the membrane 14 deforms progressively until the piercing element 11 suddenly, while piercing the lid 3, moves into the bottom position shown in FIGS. 3 and 4, in which the piercing element 11 is then held by the membrane 14 which is now bulged downwards.

It is apparent, therefore, that the bulged shape of the membrane 14 and the rigidity of the plastic material from which the membrane 14 is made ensures thereto, in the manner of a toggle point, a bi-stable state, as a result of which the membrane 14 keeps the piercing element 11 either in the upper inactive position shown in FIGS. 1 and 2, or in the lower active position shown in FIGS. 3 and 4.

It can furthermore be noted from FIG. 3 that the inside skirt 21 of the sealing cap 17 has a length which is such that the skirt 21 can co-operate with the opening 13 of the piercing element 11, ensuring the sealing off of the latter also when the piercing element is in the bottom active position.

the body 5 of the spout can be fixed onto the neck 2 by screwing instead of being fixed by clicking it on.

The membrane 14, instead of having a broken line profile, may also have an incurvate profile with double inflextion, but the broken line profile, in particular with the weakened zones at the points of inflection, permits a more "controlled" deformation of the membrane 14.

The sealing cap 17, instead of being fastened by clicking it on, may also for example by fixed by screwing it on, or may be made as an integral part of the body, being connected to the latter, for example, by a hinge of the known type.

FIGS. 5 to 8 show an embodiment of a spout according to the invention with a sealing cap with spring hinge.

With this embodiment, a bottle 101 has a neck 102 closed off by a link 103 and provided with an external screw thread 104. A spout 105 has a bottom part 106 provided with an internal screw-thread for fixing it onto the neck 102.

A piercing element 11 in the form of a round hollow body provided at its bottom end with teeth 112 and at its top with a distribution opening 113, is connected to the upper end of the bottom part 106 of the spout 105 by a membrane 114 of a generally truncated cone shape.

A sealing cap 117 is connected by a spring hinge 118, of the known type, to the outer part 119 of the spout 105. The cap 117 has a top 120 from which extends (downwards in FIG. 5) a sealing skirt 121, which over its entire length has an inside diameter slightly larger than the outside diameter of the piercing element 111. At its free end (bottom on FIG. 5), the skirt 121 has an inside rib 122.

It must furthermore be noted that an inviolability band 123 is formed onto the outer part 119 of the spout 105, which band 123 prevents the opening of the cap 117 until after the band 123 has been torn off.

Figure 5:
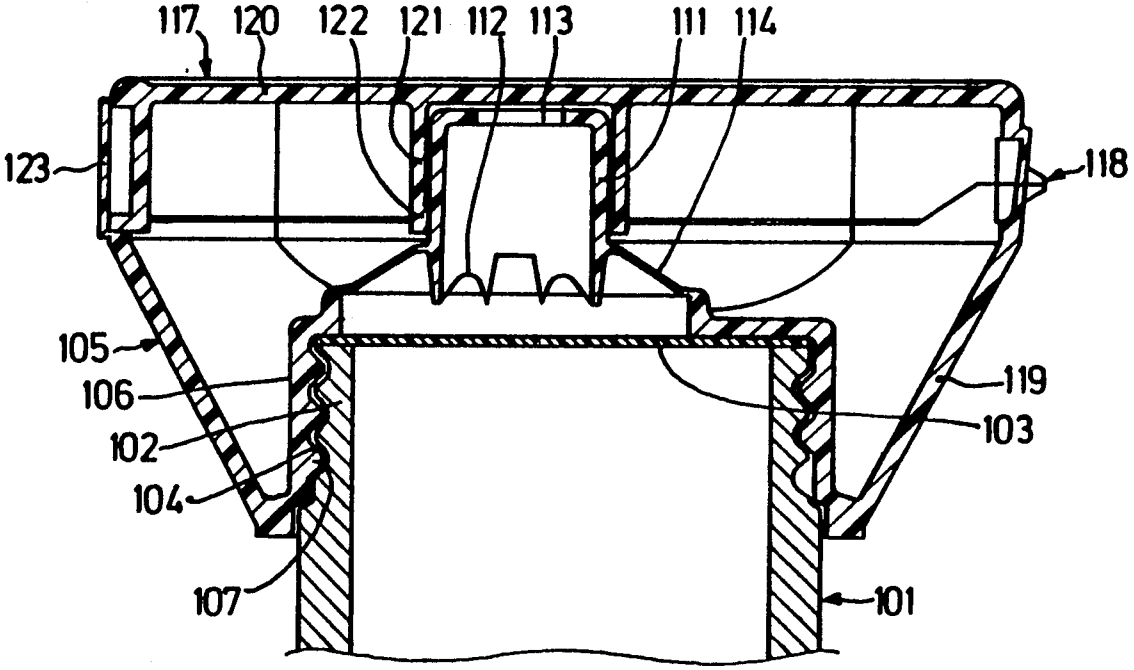
FIG. 5 is an axial cross-section of another embodiment of a spout according to the invention comprising a hinged cap, before opening the cap and before piercing the lid.

It can be noted clearly from FIG. 5 that the sealing skirt 121 co-operates, in this embodiment, with the outside of the piercing element 111, and not on the inside with the distribution opening 113 of the latter as it was the case with the embodiment of FIGS. 1 and 2.

Furthermore it is noted from FIG. 5 that the piercing element 111 is arranged in an off-center position in relation to the spout 105. In this case the piercing element 111 is positioned off-center in such a way that it is further away from the hinge 118 than from the opposite part of the spout 105.

Finally, it can be noted from FIG. 5 that the hinge 118 is arranged above the sealing plane (between the piercing element 111 and the sealing skirt 121), which plane is defined by the rib 122.

Figure 6:
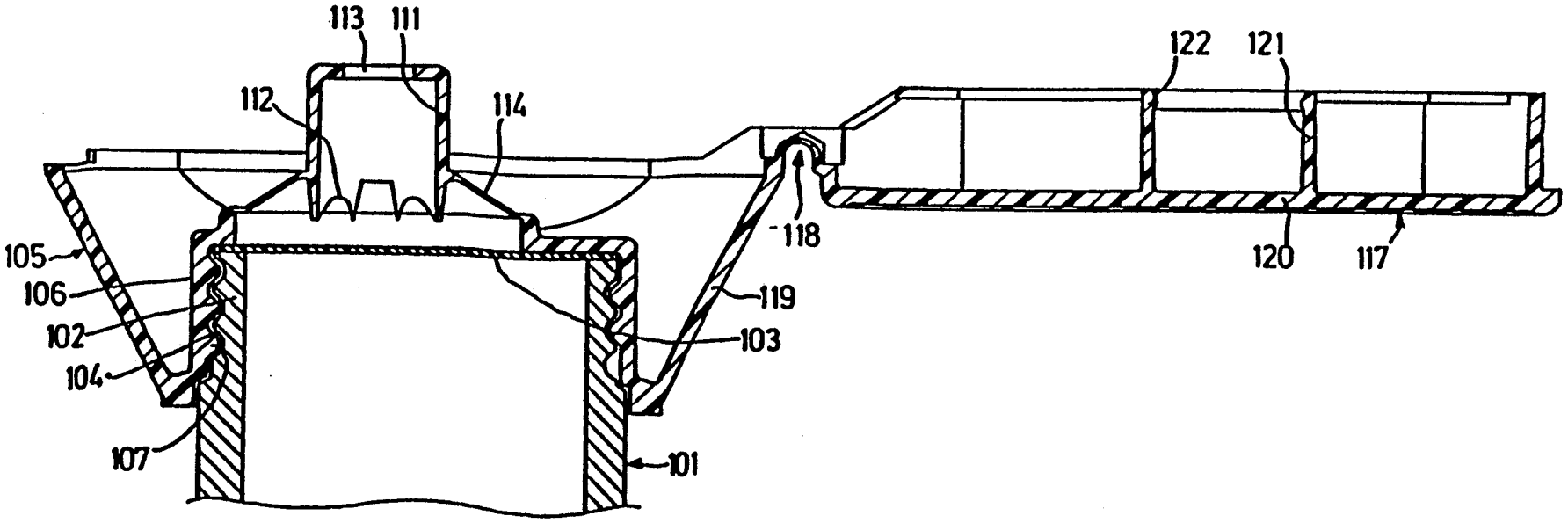
FIG. 6 is an axial cross-section corresponding to that of FIG. 5, after opening the cap, before piercing the lid.

According to FIG. 6, the cap 117 is opened by pivoting it around the hinge 118 after tearing off the guarantee band 123. However, the piercing element 111 has not yet been made to pierce the lid 103 of the neck 102 of the bottle 101.

Figure 7:
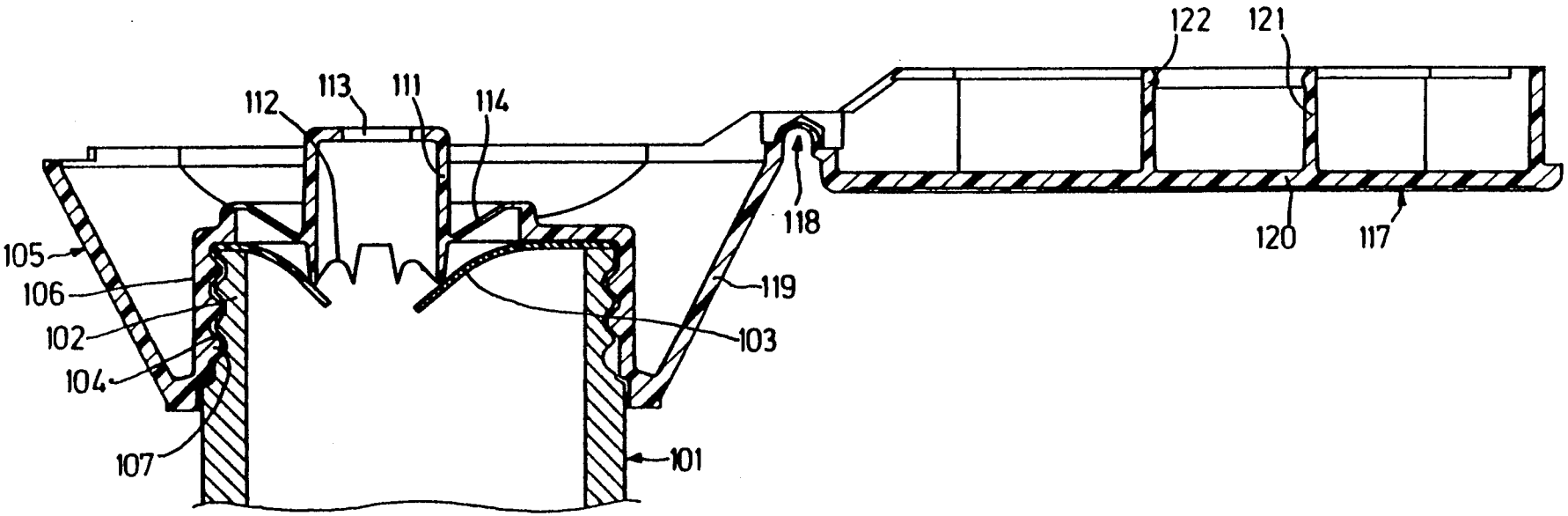
FIG. 7 is an axial cross-section according to FIG. 6 after piercing the lid.

According to FIG. 7, the piercing element 111 has been depressed, thus causing the piercing of the lid 103 of the neck 102, the membrane 114 passing from the upwardly bulged position shown in FIGS. 5 and 6 into the downwardly bulged position. In this position the content of the bottle 101 can be distributed through the opening 113 of the spout 111.

Figure 8:
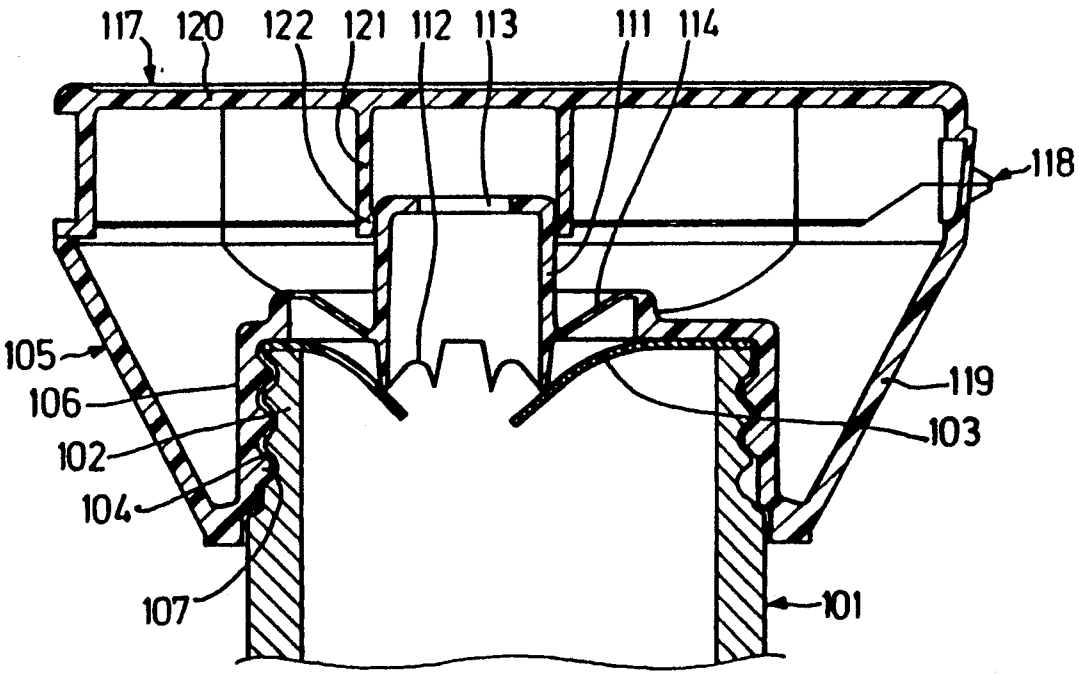
FIG. 8 is an axial section according to FIG. 7, after closing the cap.

According to FIG. 8, the cap 117 has been put back onto the spout 105 by pivoting it around the hinge 118, the piercing element 111 being held in the down position by the membrane 114. When the cap 117 is closed, the skirt 121 of the cap fits around the upper end of the piercing element 111, is crib 122 ensuring a tight sealing. The content of the bottle 101 cannot therfore run out even if the bottle is held upside down. Furthermore the content of the bottle is not subject to a drying out or to oxidation caused by an exchange of air with the outside.

I claim:

1. A spout and sealing cap assembly for a container containing a product and having a neck closed off by a lid that must be pierced for allowing dispensing of the product, said assembly comprising a spout having a body and means for fixing said body to the neck of the container, said spout further comprising a piercing and dispensing element in the form of a hollow member that has an open bottom end provided with teeth and an open top end, said piercing and dispensing element being disposed inside said body and being connected to said body by an annular bulged membrane deformable in such a manner that said piercing and dispensing element only retains a first upper position wherein said teeth are located above said lid and a second lower position wherein said teeth, having pierced said lid, are positioned below said lid, and said assembly further comprising a sealing cap which is connected to said body by a hinge, and said piercing and dispensing element being positioned off-center in relation to said body and at a distance further away from said hinge than from a side of said body opposite said fine, said sealing cap having a top section and a sealing member projecting from said top section over such a length that, when said sealing cap is in a closed position, said sealing member cooperates in a sealing fashion with said piercing and dispensing element both when said piercing and dispensing element is in said first upper position and said second lower position.

2. An assembly as recited in claim 1 wherein said sealing member includes a sealing skirt dimensioned and arranged to cooperate with said piercing and dispensing element by fitting around said piercing and dispensing element.

3. An assembly as recited in claim 2 wherein said sealing skirt includes a free end provided with an inside rib.

4. An assembly as recited in claim 3 wherein said hinge is positioned above a sealing plane defined by said rib when said cap is in a closed position.

5. An assembly adapted to be secured to a container which contains a product and has a neck closed off until first use by a lid that must be pierced for allowing distribution of the product, said assembly comprising:

a spout having a body with means for fixing said body onto the neck of the container, said spout including a hollow piercing and dispensing element having a bottom end and a top end, said bottom end being open and provided with sharp edges for piercing the lid had said top end being provided with a dispensing opening, and said spout further comprising an annular bulged membrane connecting said piercing and dispensing element to the body of said spout; and a sealing cap having a top section and a sealing member extending from said top section, said sealing cap being fittable onto the body of said spout such that when said cap is in a closed position the body of said spout is covered, and said sealing cap being dimensioned and arranged so as to be liftable off from the body of said spout such that when said cap is in an open position the body of the spout is uncovered, and said annular membrane being deformable between a first position wherein said piercing and dispensing element is in an upper position above said lid and a second position wherein said piercing and dispensing element, following piercing of the lid by said sharp edges, is in a lower position with said sharp edges positioned below the lid, and said annular member being in said first position prior of the first use of the container and said deformable membrane being positionable in said second position upon the placement of said cap in the open position and upon a pressure being exerted on said piercing and dispensing element, and wherein said sealing member projects off from said top section to such a length that in the closed position of said sealing cap, said sealing member penetrates, with sealing effect, the dispensing opening of said piercing and dispensing element both when said piercing and dispensing element is in said upper and said lower position.

6. An assembly as recited in claim 5 wherein said sealing cap, when in the closed position, is a fixed distance away from the neck of the container both when said piercing and dispensing element is in said upper and lower position.

7. An assembly as recited in claim 5 further comprising a hinge hingedly connecting said sealing cap to said spout body.

8. An assembly as recited in claim 7 wherein said piercing and dispensing element is positioned off-center in relation to the spout body and is further away from said hinge than from a side of said spout body opposite said hinge.

9. An assembly adapted to be secured to a container containing a product and having a neck closed off until first use by a lid that must be pierced of allowing destruction of the product, said assembly comprising:

a spout having a body with means for fixing said body onto the neck of the container, said spout including a hollow piercing and dispensing element having an open bottom end and an open top end, said bottom end being provided with sharp edges for piercing the lid and said spout further comprising an annular bulged membrane connecting said piercing and dispensing element to said spout body; and a sealing cap having a top section and a sealing skirt extending from said top section, said sealing cap being fitable onto the body of said spout such that when said cap is in a closed position the body of said spout is covered, and said sealing cap being dimensioned and arranged so as to be liftable off from the body of said spout such that when said cap is in an open position the body of said spout is uncovered, and said annular membrane being deformable between a first position wherein said piercing and dispensing element is in an upper position above said lid and a second position wherein said piercing and dispensing element, following piercing of the lid by said sharp edges, is in a lower position with said sharp edges positioned below the lid, and said annular membrane being in said first position prior to the first use of the container and said deformable membrane being positionable in said second position upon the placement of said cap in the open position and upon a pressure being exerted on said piercing and dispensing element, and wherein said sealing skirt projects off from said top section to such a length that in the closed position of said sealing cap, said sealing skirt extends below the top end of said piercing and dispensing element such that said sealing skirt, with sealing effect, fits around said piercing and dispensing element both when said piercing and dispensing element is in said upper and lower positions, and said assembly further comprising a fine hingedly connecting said sealing cap to said spout body.

10. An assembly as recited in claim 9 wherein said sealing cap, when in the closed position, is a fixed distance away from the neck of the container both when said piercing and dispensing element is in said upper and said lower position.

11. An assembly as recited in claim 9 wherein said sealing skirt includes a free end having an inside annular rib.

12. An assembly as recited in claim 9 wherein said piercing and dispensing element is positioned off-center in relation of the body of said spout and is further away from said hinge than from a side of said body opposite said hinge.

13. An assembly as recited in claim 11 wherein said hinge is arranged above a sealing plane defined by said inside annular rib when said cap is in the closed position.

* * * * *